US011280157B2

(12) United States Patent
Acosta et al.

(10) Patent No.: US 11,280,157 B2
(45) Date of Patent: Mar. 22, 2022

(54) MULTI-STAGE CEMENTING TOOL

(71) Applicant: Halliburton Energy Services, Inc., Houston, TX (US)

(72) Inventors: Frank Vinicio Acosta, Spring, TX (US); Lonnie Carl Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 8 days.

(21) Appl. No.: 16/932,423

(22) Filed: Jul. 17, 2020

(65) Prior Publication Data

US 2022/0018213 A1 Jan. 20, 2022

(51) Int. Cl.
*E21B 33/16* (2006.01)
*E21B 33/14* (2006.01)

(52) U.S. Cl.
CPC ..... *E21B 33/16* (2013.01); *E21B 33/146* (2013.01)

(58) Field of Classification Search
CPC ..... E21B 33/16; E21B 33/146; E21B 33/14; E21B 43/26; E21B 34/14; E21B 33/13
See application file for complete search history.

(56) References Cited

U.S. PATENT DOCUMENTS

| | | | |
|---|---|---|---|
| 3,948,322 | A | 4/1976 | Baker |
| 4,674,569 | A | 6/1987 | Revils et al. |
| 5,279,370 | A | 1/1994 | Brandell et al. |
| 5,647,434 | A | 7/1997 | Sullaway et al. |
| 5,765,641 | A | 6/1998 | Shy et al. |
| 6,026,903 | A | 2/2000 | Shy et al. |
| 6,244,342 | B1 | 6/2001 | Sullaway et al. |
| 6,802,373 | B2 | 10/2004 | Dillenbeck et al. |
| 7,857,052 | B2 | 12/2010 | Giroux et al. |
| 8,215,404 | B2 | 7/2012 | Makowiecki et al. |
| 8,616,276 | B2 | 12/2013 | Tips et al. |
| 8,646,537 | B2 | 2/2014 | Tips et al. |
| 8,720,561 | B2 | 5/2014 | Zhou |
| 9,010,442 | B2 | 4/2015 | Streich et al. |
| 9,291,007 | B2 | 3/2016 | Darbe et al. |

(Continued)

FOREIGN PATENT DOCUMENTS

EP 1262629 A1 12/2002

OTHER PUBLICATIONS

Halliburton Brochure, "Cementing ES II Stage Cementer," Feb. 2009.

(Continued)

*Primary Examiner* — Tara Schimpf
(74) *Attorney, Agent, or Firm* — McAfee & Taft

(57) ABSTRACT

A cementing tool has an outer housing defining a central flow passage and a plurality of housing flow ports through a wall thereof. An opening sleeve has first and second opening sleeve faces exposed to housing pressure. The first opening sleeve face has a greater surface area than the second opening sleeve face. The pressure differential created is such that the sleeve will move from a first position to a second position in which flow through the plurality of housing flow ports is permitted. The cementing tool has an opening seat defined on the opening sleeve. The opening sleeve may also be moved from the first to the second position as a result of the engagement of the opening plug with the opening seat and an application of pressure thereabove.

20 Claims, 9 Drawing Sheets

(56) References Cited

U.S. PATENT DOCUMENTS

| | | | | |
|---|---|---|---|---|
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,816,351 | B2 | 11/2017 | Lirette et al. | |
| 9,920,620 | B2 | 3/2018 | Murphree et al. | |
| 10,024,150 | B2 | 7/2018 | Andreychuk et al. | |
| 10,316,619 | B2 * | 6/2019 | de Oliveira | E21B 47/13 |
| 10,358,914 | B2 | 7/2019 | Roberson et al. | |
| 10,557,329 | B2 | 2/2020 | Gao et al. | |
| 2006/0207765 | A1 * | 9/2006 | Hofman | E21B 43/12 166/313 |
| 2009/0151960 | A1 | 6/2009 | Rogers et al. | |
| 2013/0048290 | A1 | 2/2013 | Howell et al. | |
| 2019/0017366 | A1 | 1/2019 | Alaas et al. | |
| 2019/0249549 | A1 | 8/2019 | Fripp et al. | |

OTHER PUBLICATIONS

Halliburton Brochure, "Fidelis Stage Cementer," Sep. 2013.
International Search Report and Written Opinion dated Apr. 5, 2021, in corresponding PCT Application No. PCT/US2020/053694.
Halliburton Catalog titled "Casing Equipment" (2015), entire catalog.

* cited by examiner

MULTI-STAGE CEMENTING TOOL

BACKGROUND

Casing strings are generally cemented in a well bore by pumping a cement slurry through the casing string and outward from a lower end of the casing string and into the annulus between the casing string and a well bore wall which may be for example an open well bore or a previously cemented casing. Oftentimes the entire length of the casing string may not be cemented within the well bore and as a result a procedure known as multi-stage cementing is used.

Generally the casing in the well is cemented in separate stages beginning at the bottom of the well and working upward. The process is achieved by placing cementing tools in the casing at one or more locations in the well bore, flowing cement through the bottom of the casing and up the annulus to the lowest cementing tool, closing off the bottom, opening the cementing tool and flowing cement through the cementing tool up the annulus to the next upper stage and repeating this process until all stages of cementing the well are completed.

BRIEF DESCRIPTION OF THE DRAWINGS

FIG. 6 is a cross-sectional view of an additional embodiment of the cementing tool.

DETAILED DESCRIPTION OF THE EMBODIMENT

Figure 1:
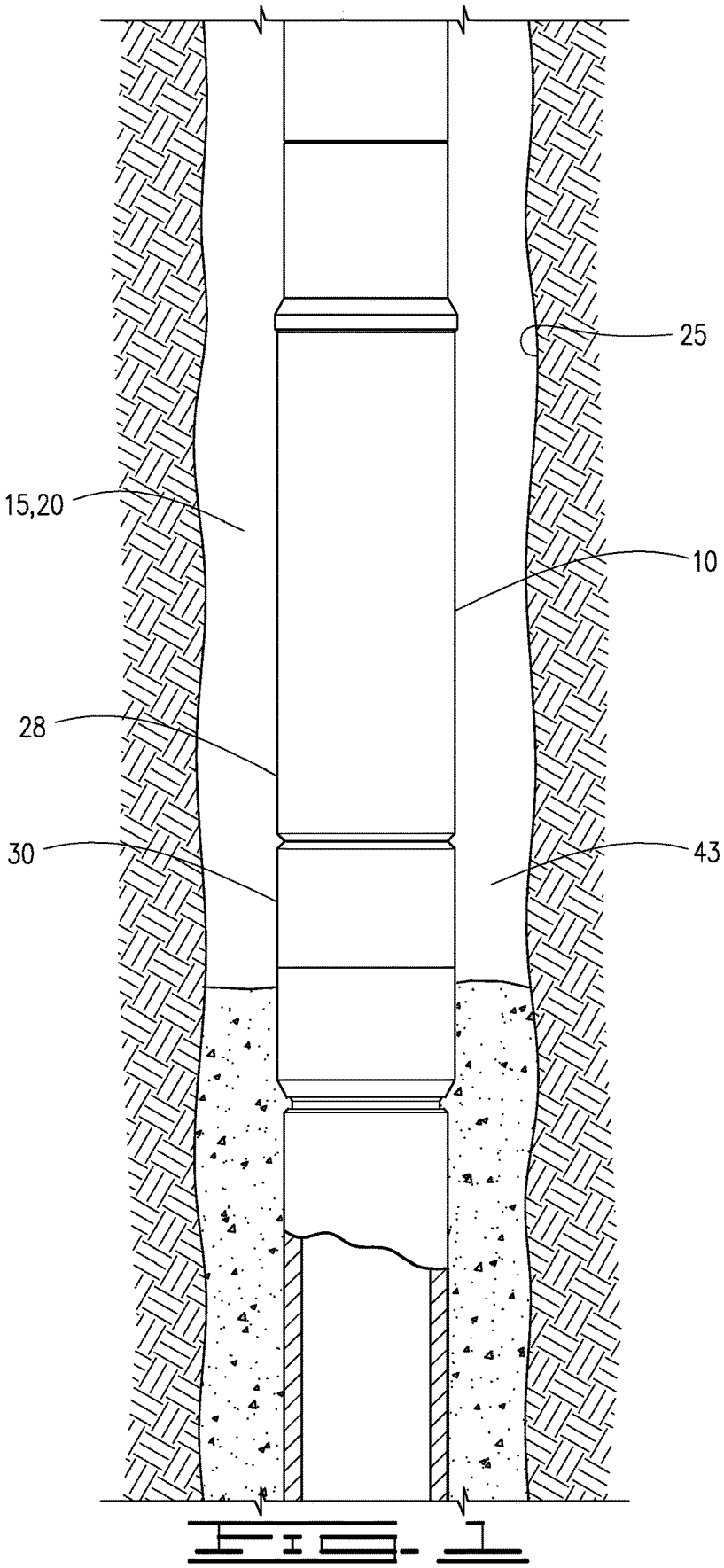
FIG. 1 is schematic embodiment of a casing in a well borehole including a cementing tool.

FIG. 1 shows casing 10 lowered into a well 15. Well 15 comprises a well bore 20 having well bore wall 25. Although in the embodiment described casing 10 is shown lowered into a well that is an open well bore with well bore wall 25 it is understood that well bore wall 25 may include a previously cemented casing.

Cementing tool 30 is connected in casing string 10. As shown in the schematic of FIG. 1 casing 10 has a previously cemented section below cementing tool 30.

Referring first to FIG. 6 an embodiment of a cementing tool is shown. Cementing tool 30 has outer housing 32 with upper end 34 and lower end 36. Upper and lower ends 34 and 36 are configured to be connected in casing 10 by threading or other means known in the art. Cementing tool 30 defines a central flow passage 38 therethrough.

Outer housing 32 has a plurality of housing flow ports 40 defined through a wall 42 thereof. Housing flow ports 40 are communicated with an annulus 43 defined by well bore wall 25 and cementing tool 30. Housing flow ports 40 are spaced circumferentially about outer housing 32 and may comprise for example anywhere from three to eight housing flow ports 40. Outer housing 32 comprises upper housing 44 threadedly connected to a lower housing 46.

Cementing tool 30 is shown in a first or initial closed position 52 in FIG. 6. Outer housing 32 has inner surface 54 in which groove 41 is defined, and which defines a first inner diameter 56. First inner diameter 56 is defined on lower outer housing 46. A second inner diameter 58 is defined by outer housing 32 and specifically by lower outer housing 46. An upward facing shoulder 60 is defined by and between first inner diameter 56 and second inner diameter 58.

An opening sleeve 62 is disposed in outer housing 32. Opening sleeve 62 is sealingly and slidably disposed in outer housing 32. Opening sleeve 62 is shown in its first or initial closed position which is the first or initial closed position 52 of the cementing tool 30.

Opening sleeve 62 has upper end 64 and lower end 66. Opening sleeve 62 has outer surface 68 defining a first outer diameter 70 and a second outer diameter 72. First outer diameter 70 is greater than second outer diameter 72. A shoulder 74 which is a downward facing shoulder 74 is defined by and between first and second outer diameters 70 and 72 respectively. First opening sleeve face 76 is at upper end 64 and second opening sleeve face 78 is at lower end 66.

Opening sleeve 62 has a plurality of fluid openings 80 defined in a wall thereof. In the first position of the opening sleeve 62 flow through fluid openings 80 is prevented by outer housing 32. A groove 84 is defined in outer surface 68 at second outer diameter 72 and receives a lock ring 82. Lock ring 82 extends into a groove 86 defined in a stop piston 88. Shear pins 94 detachably connect stop piston 88 to outer housing 32. Snap ring 82 detachably connects opening sleeve 62 to stop piston 88. Stop piston 88 has upper end 90 and lower end 92.

O-ring seals 96 may be placed in grooves 98 so that opening sleeve 62 will slide easily and sealingly engage with outer housing 32. Likewise, O-ring seals and grooves may be utilized in stop piston 88 to sealingly engage outer housing 32.

An opening seat ring 100 defines an opening seat 102 thereon for receiving and engaging an opening plug 104 displaced through casing 10 into cementing tool 30. Opening plug 104 has nose 106 and engagement surface 108. Opening sleeve 62 has a closing ring 110. Closing ring 110 may be connected to opening sleeve 62 by means known in the art, for example with an adhesive, or by threading. Closing ring 110 defines a closing seat 112 thereon. Closing seat 112 is positioned and configured to receive and engage a closing plug 114 displaced into cementing tool 30.

A protective sleeve 120 having an inner diameter 122 defined by inner surface 123 is connected to closing ring 110. Protective sleeve 120 has a plurality of flow apertures 126 defined therethrough. Flow apertures 126 are communicated with a fluid passageway 128 defined by and between outer housing 32 and protective sleeve 120. First opening sleeve face 76 is open to housing pressure through fluid passageway 128. The housing pressure is the casing or tubing pressure through central flow passage 38.

In operation casing 10 is lowered into a well 15 into a desired location. Although in the embodiment described well 15 is shown as vertical it is understood that the discussion herein is equally applicable to deviated and/or horizontal wells. Likewise, while the well bore described herein has a well bore wall 25 that is uncased, it is understood that the embodiments of the cementing tool disclosed herein may be used in a well that has previously been cased.

Figure 7:
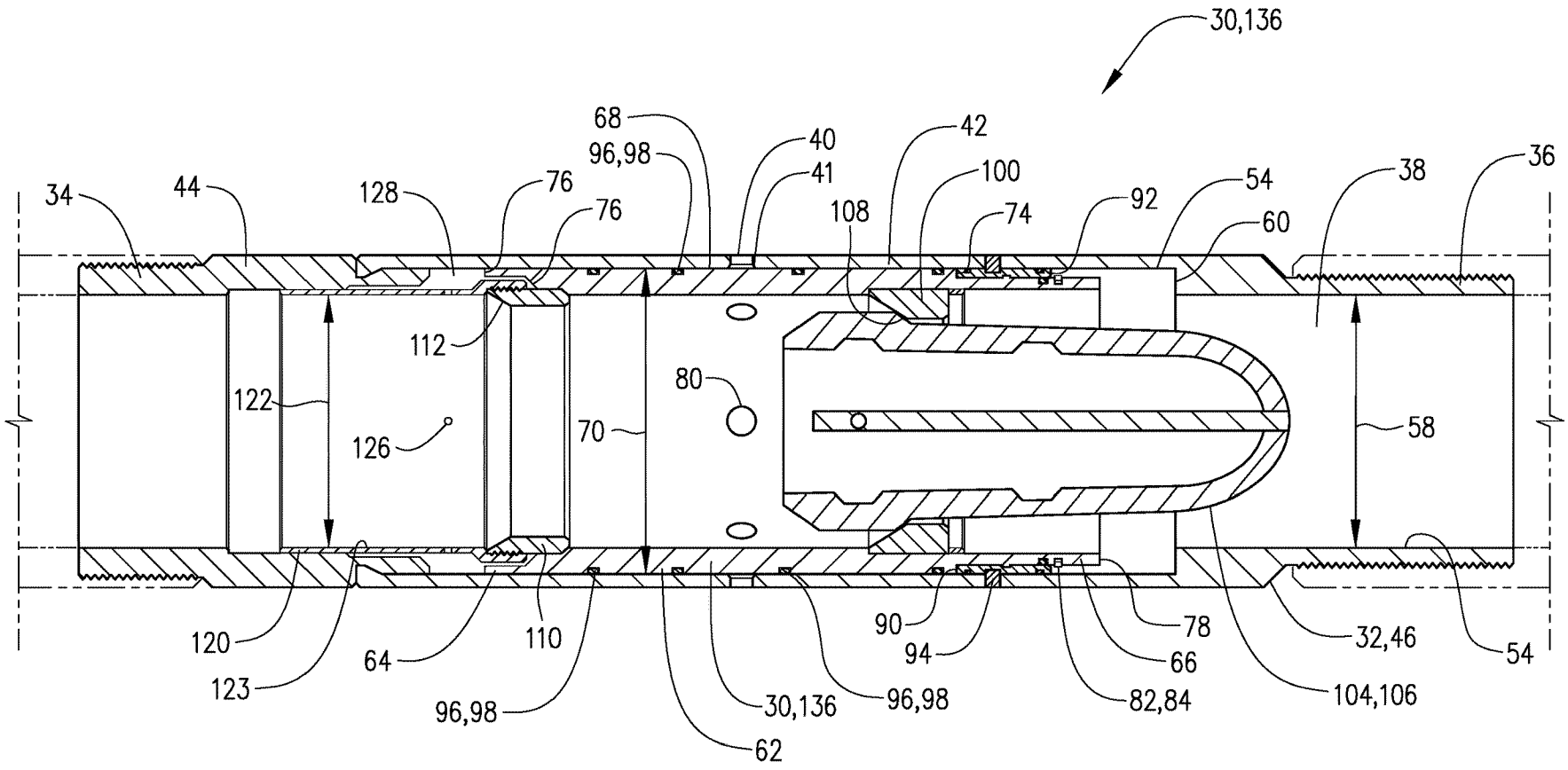
FIG. 7 is a cross-sectional view of the opening sleeve of FIG. 6 moved to an open position.

Once casing 10 has been lowered and cementing below cementing tool 30 has been properly cemented, pressure is increased in the tubing and thus in housing 32. The increase in pressure is accomplished by blocking flow through the casing 10 below the cementing tool 30. The housing pressure acts on first opening sleeve face 76 through fluid passageway 128 and creates a differential pressure as a result of the greater surface area of first opening sleeve face 76 as compared to the surface area of second opening sleeve face 78. Housing pressure may be increased until the differential pressure is sufficient to cause lock ring 82 to be forced radially inward out of groove 86 in stop piston 88, so that opening sleeve 62 is moved from the first position 52 to a second position 136 which is the open position of cementing tool 30 and opening sleeve 62. The second position is shown in FIG. 7 and is the position in which flow through ports 40 in wall 42 is permitted from central flow passage 38. Cement will flow through fluid openings 80 and into and through housing flow ports 40. Stop piston 88 stops the downward movement of opening sleeve 62 to hold the opening sleeve in the second position 136 until the cementing through tool 30 is complete.

While FIG. 7 shows an opening plug 104 it is understood that the opening sleeve 62 may be moved to the second position 136 with differential pressure as described above, or by applying pressure in the casing 10 above the opening plug 104 after it has engaged opening seat 102. Thus the opening sleeve can be moved either solely with the use of differential pressure generated by the housing pressure acting on first and second opening sleeve faces 76 and 78 or by increased pressure in the housing applied above a seated opening plug 104. If desired, opening plug 104 may be displaced into cementing tool 30 to engage opening seat 102. Once opening plug 104 engages seat 102 housing pressure can be increased thereabove to cause lock ring 82 to radially retract out of groove 86 and stop piston 88. Stop piston 88 will hold opening sleeve 62 in the second position 136 until such time as it is desired to move the opening sleeve 62 to the third position 138 as described herein.

Figure 8:
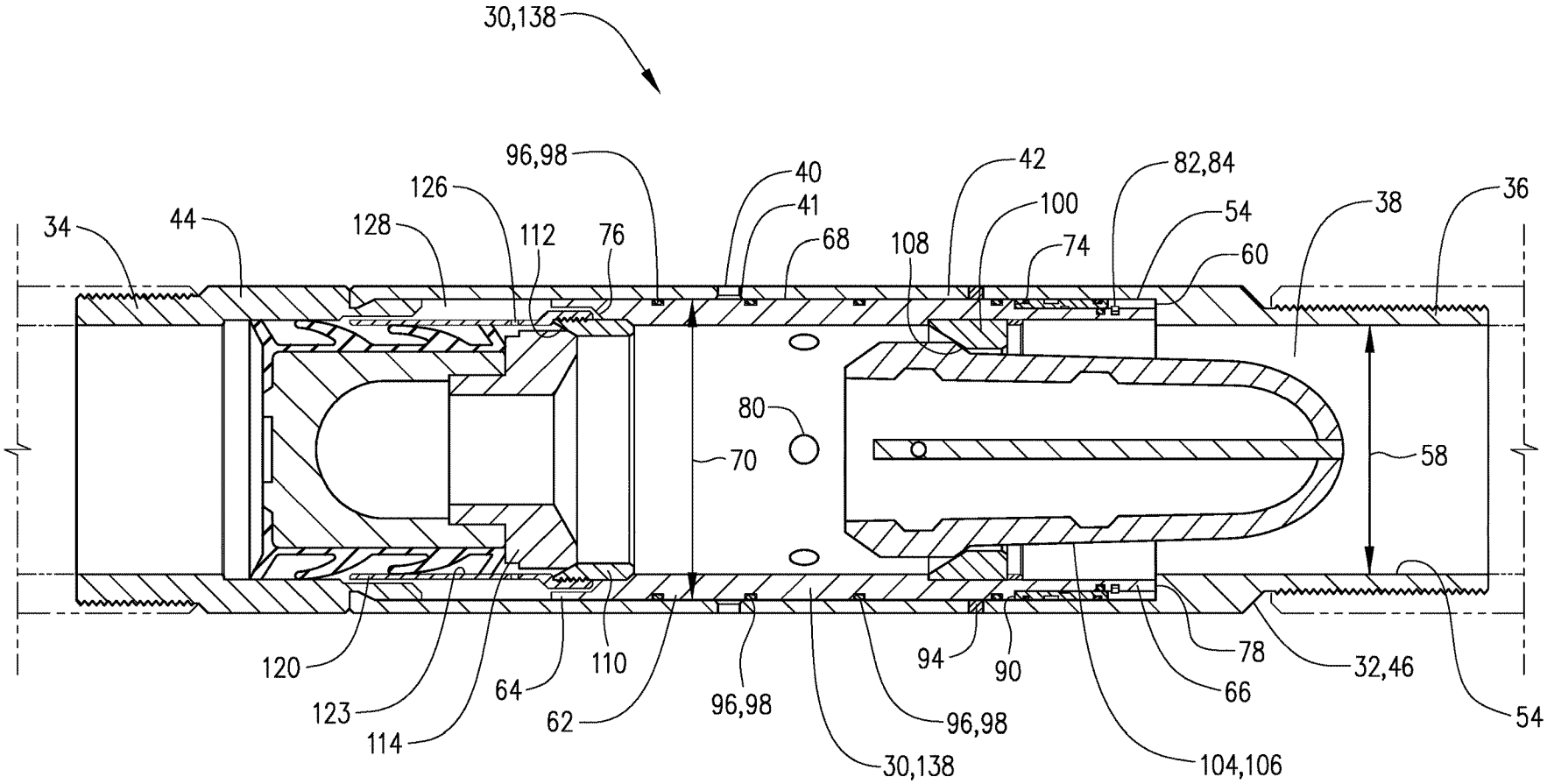
FIG. 8 is a cross-sectional view of the opening sleeve of FIG. 6 moved from an open position to a closed position.
Figure 9:
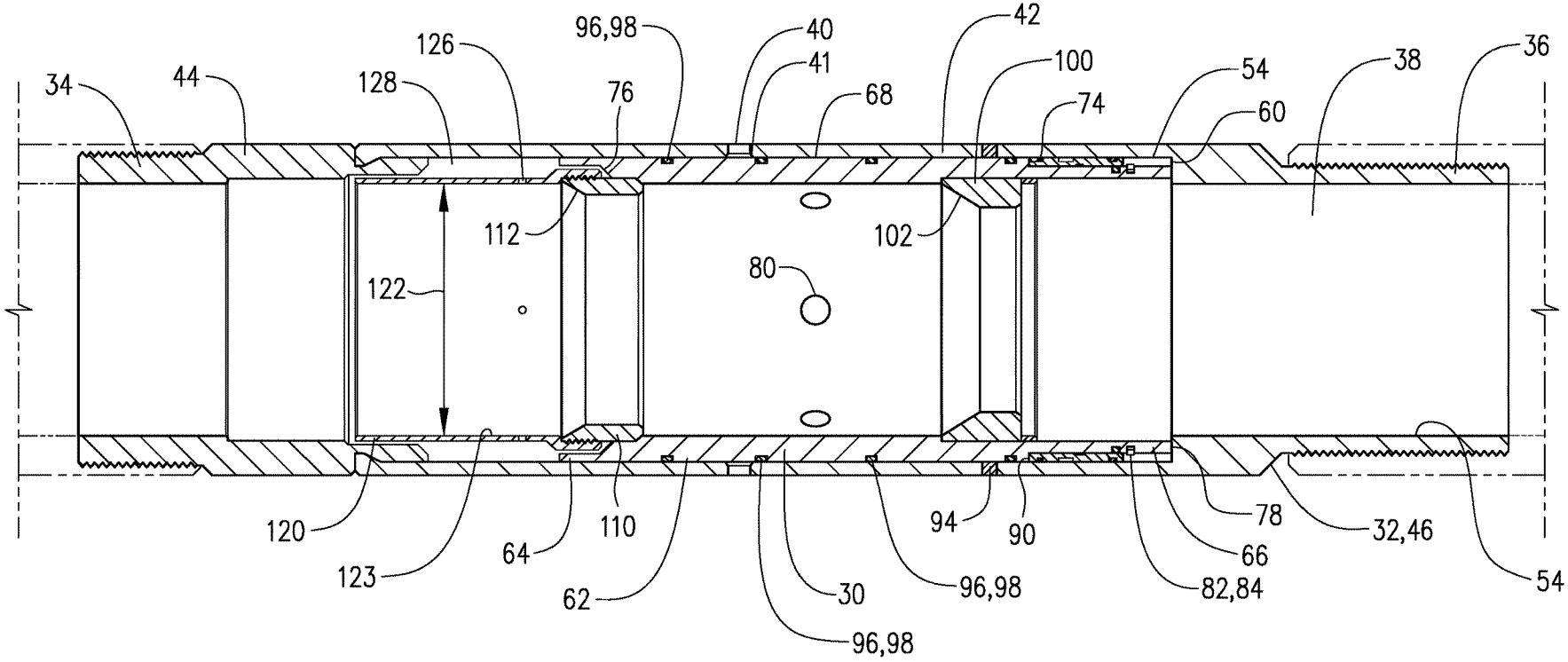
FIG. 9 is a section view of the embodiment of FIG. 6 after cementing through the cementing tool is complete and the opening and closing plugs are drilled out or otherwise removed.

In the open, or second position 136 of the opening sleeve 62 cement may be flowed through fluid openings 80 and communicated through housing flow ports 40 into annulus 43 between casing 10 and well bore wall 25. Once the cementing job is complete a closing plug 114 may be displaced into cementing tool 30 to engage closing seat 112. Housing pressure may be increased until a predetermined pressure is reached sufficient to apply a force to shear the shear pins 94 that detachably connect stop piston 88 to outer housing 32. Opening sleeve 62 will move from the second position 136 to a third position 138. Third position 138 is a closed position and is shown in FIGS. 8 and 9. Once the opening sleeve 32 has been moved to its third position in which the opening sleeve 62 prevents flow through fluid ports 40, closing plug 114 may be drilled out and if used, opening plug 104 may be drilled out as well so that as shown in FIG. 9 a completely open bore exists after cementing is complete. Opening plug 104 and closing plug 114 may be knurled or have anti-rotation teeth as are known in the art that engage and prevent relative rotation therebetween. In the described embodiment, the use of opening plug 104 is at the discretion of the end user. Cementing tool 30 combines the efficiency of removing the need to drill out multiple plugs by providing an option to open with differential pressure, while allowing for the contingency of hydraulically opening with a conventional plug dropping opening method.

An additional embodiment of a cementing tool 150 is shown in FIGS. 2 through 5. Cementing tool 150 includes an outer housing 152 with upper and lower end 154 and 156 connectable in casing 10. Outer housing 152 comprises upper connector 158, lower connector 160 and a connecting sleeve 162 therebetween. Outer housing 152 has an inner surface 164 which defines a first inner diameter 166, second inner diameter 168 and third inner diameter 170. First inner diameter 166 is smaller than second inner diameter 168 and second inner diameter 168 is smaller than third inner diameter 170. First and second inner diameters 166 and 168 define upward facing shoulder 172 therebetween and second and third inner diameters 168 and 170 define upward facing shoulder 174. Outer housing 152 has a plurality of housing flow ports 176 in the wall thereof. Relief ports 175 are defined in the wall of outer housing 152. In a first position 178 of the cementing tool 150, which is also the first position of an opening sleeve 180, flow through housing flow ports 176 is blocked with opening sleeve 180.

Opening sleeve 180 has first or upper end 182 and second or lower end 184. A first opening sleeve face 186 is defined at upper end 182 and a second opening sleeve face 188 is defined at lower end 184. First opening sleeve face 186 has a greater surface area than second opening sleeve face 188 such that a differential pressure is created by the tubular pressure in the casing 10, which is the same as the pressure in outer housing 152. The tubular pressure, also referred to as casing pressure, can be increased so that a downwardly applied force is created to move opening sleeve 180 from the first position 178. Opening sleeve 180 has outer surface 190 which defines first outer diameter 192 and second outer diameter 194. Shoulder 196 is defined by and between first outer diameter 192 and second outer diameter 194. Annulus 195 is defined between outer diameter 194 of opening sleeve 180 and inner diameter 170 of outer housing 152. Annulus 195 is communicated with relief ports 175. Opening sleeve 180 has opening ring 200 connected thereto in a manner known in the art, for example with an adhesive, threaded or other known means. Opening seat 202 is defined on opening ring 200. Opening sleeve 180 is shown in a second position 204 in FIG. 3 in which flow through housing flow ports 176 is permitted. Opening sleeve 180 is held in the first position 178 with shear pins 206 or other means known in the art. The shear pins will break at a predetermined pressure in the casing. Once a sufficient force is applied to opening sleeve 180 as a result of the differential pressure applied, or as a result of hydraulic pressure applied to an opening plug as described below, the shear pins will break and the opening sleeve will move to second position 204.

A closing sleeve 210 is detachably connected to outer housing 152 with shear pins 211 or other means known in the art. Closing sleeve 210 has upper end 212 and lower end 214. A space 218 is defined between lower end 214 of closing sleeve 210 and first opening sleeve face 186 such that first opening sleeve face 186 is open to tubular pressure in housing 152. In other words the housing pressure is communicated to first opening sleeve face 186 through space 218. Lower opening sleeve face 188 is likewise exposed to tubular pressure. O-ring seals 224 disposed in grooves 220 slidingly and sealingly engage outer housing 152. A closing ring 226 is connected to closing sleeve 210 and defines a closing seat 228 thereon. A protective sleeve 230 is connected to closing sleeve 210 and movable therewith. Protective sleeve 230 has ports 229 therethrough to aid in preventing pressure traps.

Figure 3:
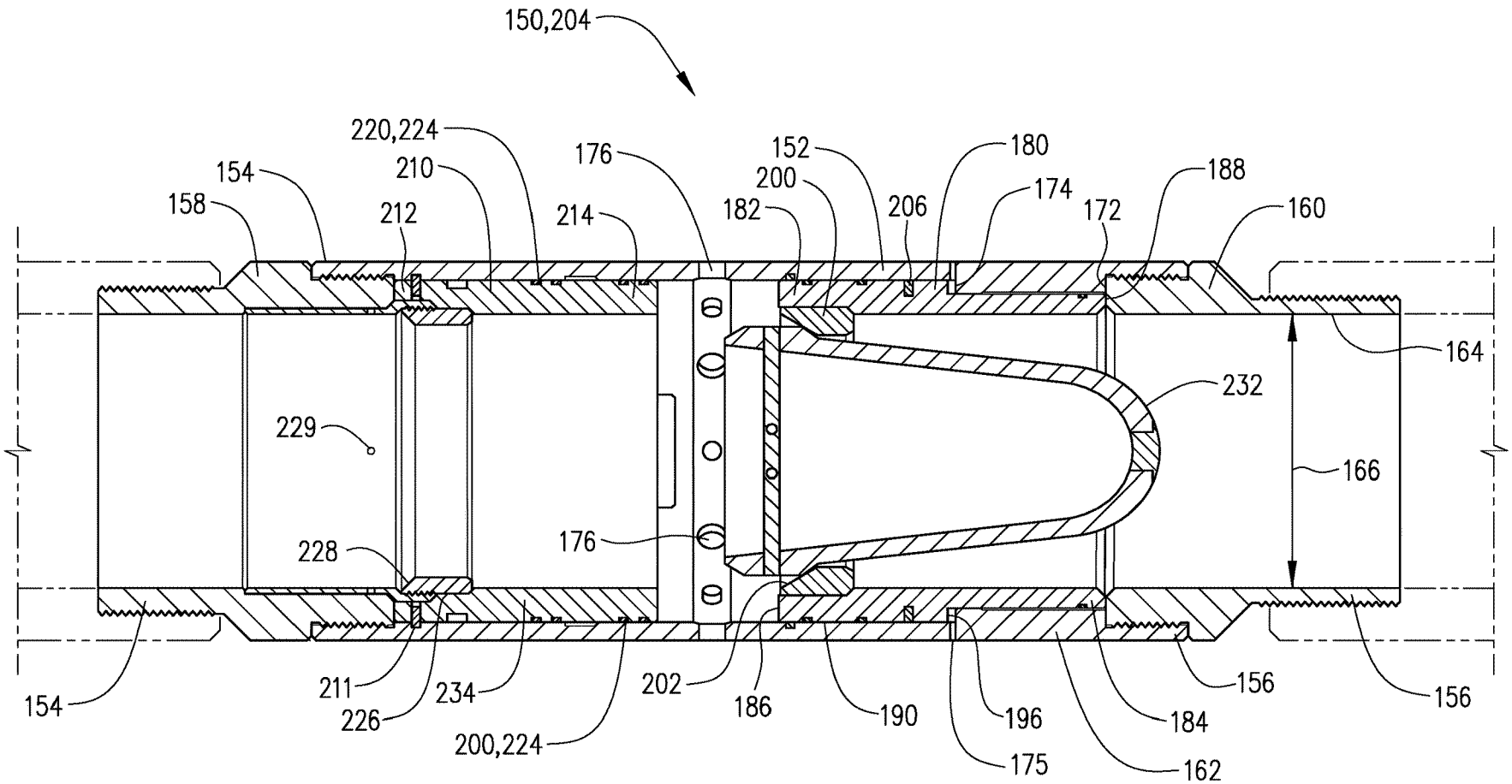
FIG. 3 is a cross-sectional view of the cementing tool of FIG. 2 showing an opening sleeve moved to an open position.

In operation, cementing tool 150 is lowered with casing 10 into well bore 20. Once cement has been delivered into the well below cementing tool 150 tubular pressure is applied to move the opening sleeve 180 from the first position 178 to a second position 204 shown in FIG. 3. In the second position 204 the plurality of ports 176 are uncovered and cement may be flowed therethrough into the annulus 43 between casing 10 and well bore wall 25. In FIG. 3 an opening plug 232 is shown. Opening plug 232 may be displaced into tubing 10 to engage opening seat 202. Pressure may be increased thereabove until a sufficient force is developed sufficient to shear pins 206 and move opening sleeve 180 to the second position 204. Rather than using opening plug 232, opening sleeve 180 may be moved utilizing differential pressure generated as a result of the differential area between first opening sleeve face 186 and second opening sleeve face 188.

Figure 2:
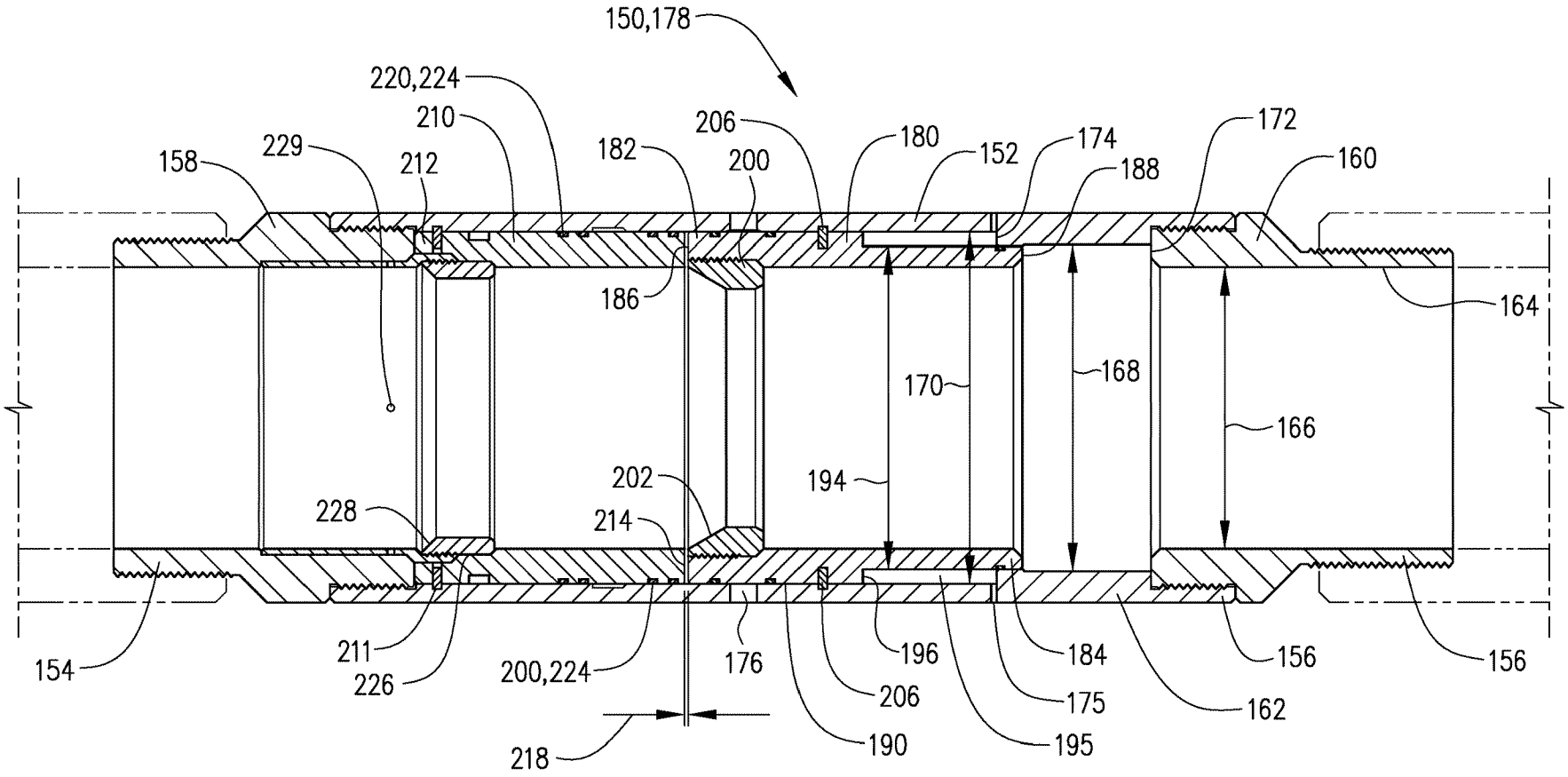
FIG. 2 is cross-sectional view of an embodiment of the cementing tool in a run-in position.
Figure 4:
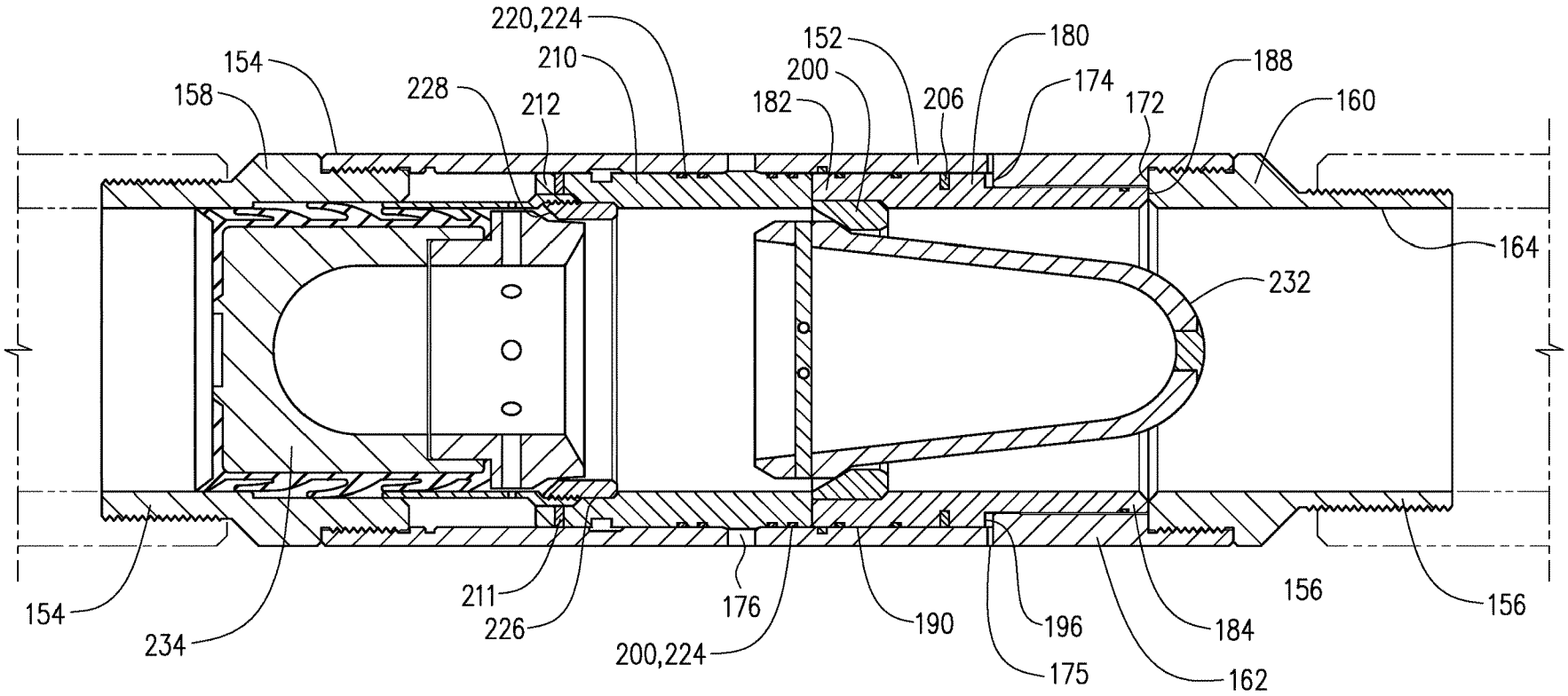
FIG. 4 is a cross-sectional view of the embodiment of FIG. 2 showing a closing sleeve moved to a closed position.
Figure 5:
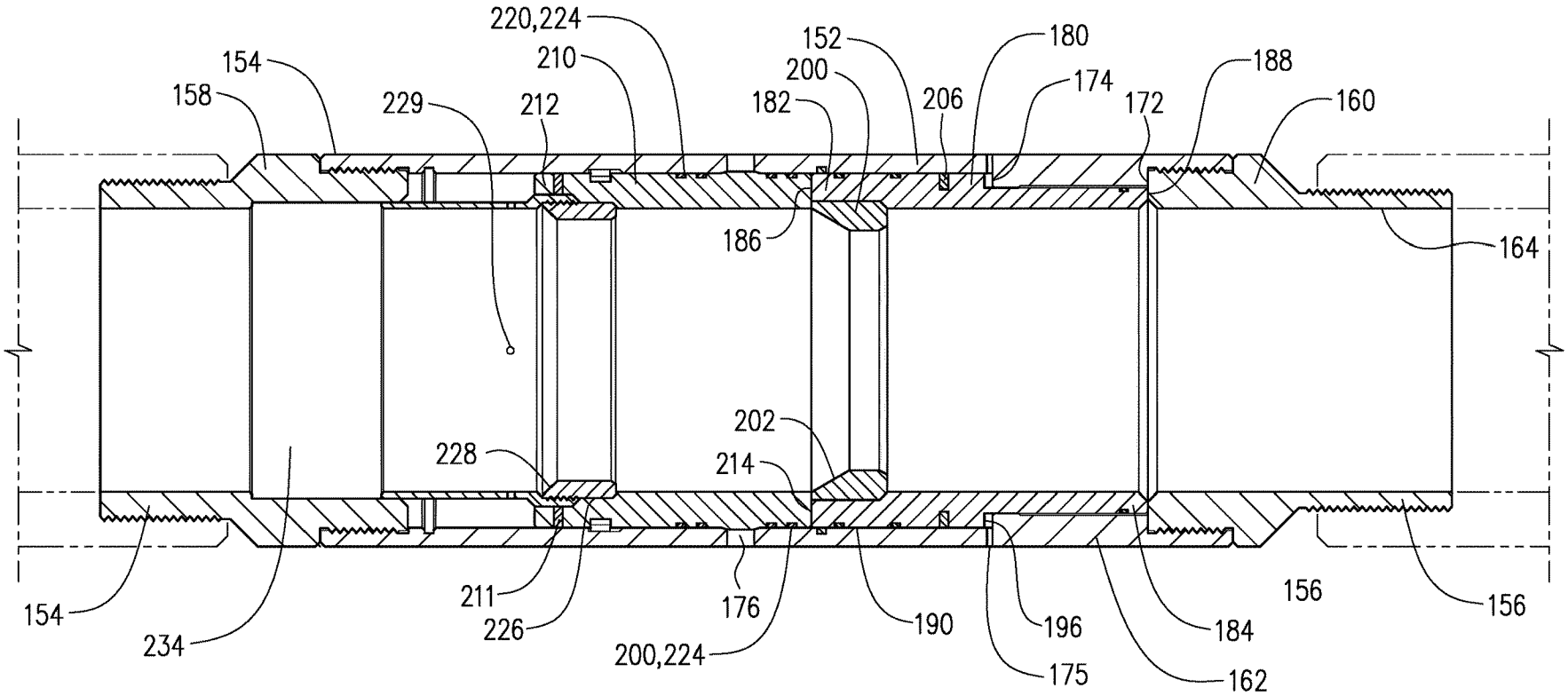
FIG. 5 is a section view of the embodiment of FIG. 2 after stage cementing is complete.
Figure 5:
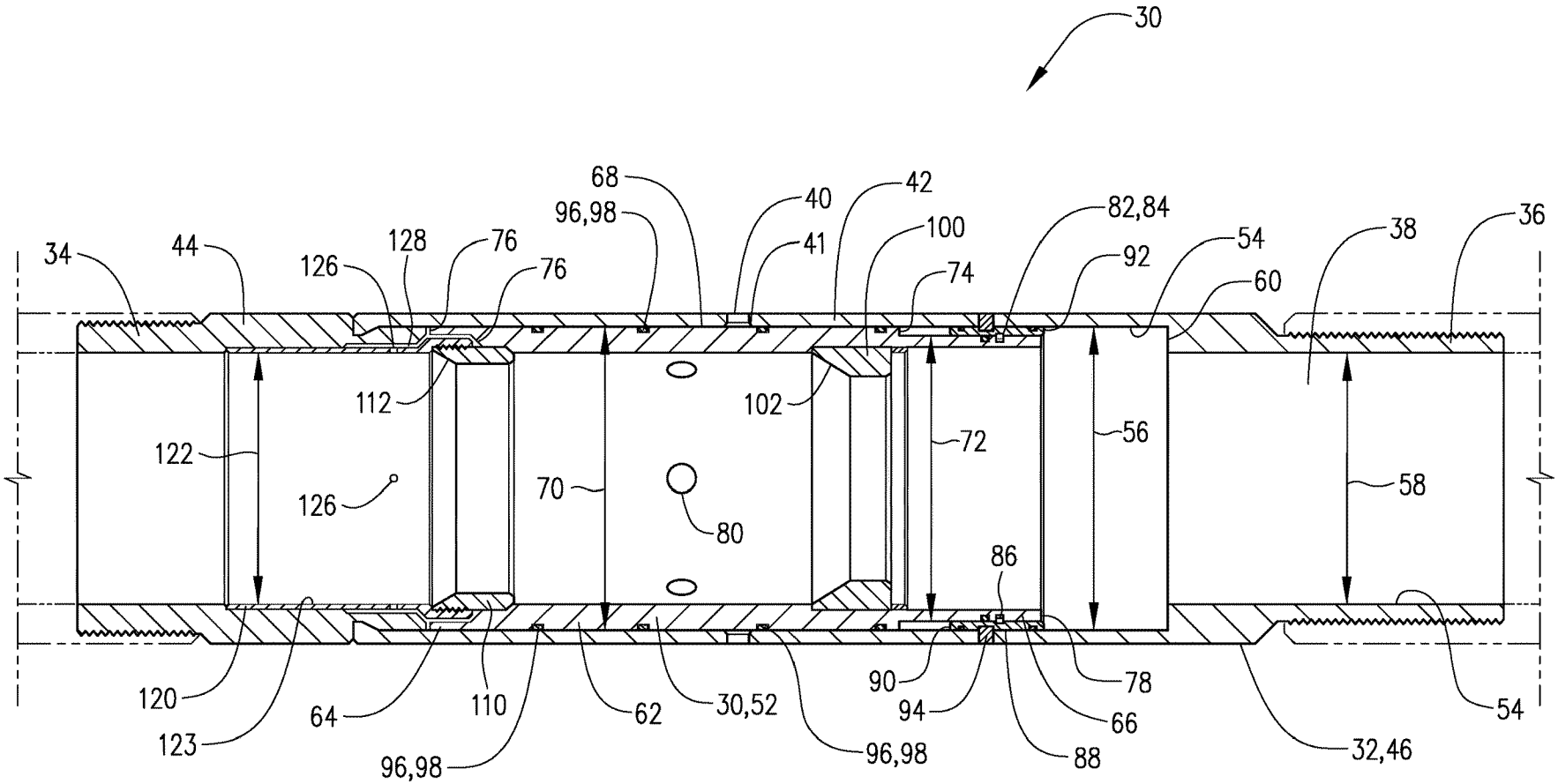

Once a sufficient amount of cement has been displaced through housing flow ports 176 a closing plug 234 may be displaced into casing 10 to engage closing seat 228. In FIGS. 2 and 3 closing sleeve 210 is shown in its first position 238. Once closing plug 234 engages closing seat 228 pressure thereabove may be increased to shear the pins 211 that detachably connect the closing sleeve 210 to outer housing 152 to move the closing sleeve to its second position in which housing flow ports 176 are blocked so that no further flow is permitted therethrough. This position is shown in FIG. 4. In the position shown in FIG. 5 both plugs have been drilled out to provide an open bore through casing 10.

Embodiments disclosed herein include:

Embodiment A

A cementing tool that includes an outer housing defining a central flow passage and a plurality of flow ports through a wall thereof, an opening sleeve having a first opening sleeve face and a second opening sleeve face exposed to housing pressure, the first opening sleeve face having a greater surface area than the second opening sleeve face so that the housing pressure creates a pressure differential between the first opening sleeve face and the second opening sleeve face such that the sleeve will move from a first position covering the plurality of flow ports to a second position in which flow through the plurality of flow parts is permitted, and an opening seat defined on the opening sleeve configured to receive an opening plug displaced into the housing, the opening sleeve also being movable from the first to the second position as a result of the engagement of the opening plug with the opening seat and an application of pressure thereabove.

Embodiment C

A cementing tool that includes an outer housing defining a central flow passage therethrough and a plurality of housing flow ports in a wall thereof, an opening sleeve detachably connected in the outer housing, the opening sleeve having first and second sleeve faces defined thereon open to tubular pressure and movable from a first position in which flow from the central flow passage through the housing flow ports is prevented to a second position in which flow from the flow passage through the housing flow ports is permitted, the first sleeve face having a greater surface area than the second sleeve face such that the tubular pressure can create a differential pressure sufficient to detach the opening sleeve from the housing and move the opening sleeve from the first to the second position, and an opening seat defined in the opening sleeve configured to receive an opening plug such that sufficient tubular pressure can be applied above the opening plug to move the opening sleeve from the first to the second position.

Embodiments A and C may have one or more of the following additional elements in any combination.

A plurality of fluid openings in the opening seat.

A closing seat for receiving a closing plug.

A closing sleeve, separate from the opening sleeve in which a closing seat is defined.

A stop piston for holding the opening sleeve in a second position.

An additional embodiment B is disclosed:

A cementing tool that includes an outer housing connectable in a tubing string, the outer housing defining a central flow passage and having a plurality of flow ports through a wall thereof, an opening sleeve movable in the outer housing from a first position in which flow through the flow ports is blocked to a second position in the outer housing in which flow from the central flow passage is permitted through the flow ports in the outer housing, and the opening sleeve being movable from the second to a third position in the housing in which flow through the flow ports from the central flow passage is prevented.

Embodiment B may have one or more of the following additional elements in any combination.

First and second sleeve faces defined on the opening sleeve and open to tubular pressure, the first sleeve face having a greater surface area then the second sleeve face so that a differential pressure is set up to move the opening sleeve from the first position to the second position.

A closing seat configured to engage a closing plug, the opening sleeve movable from the second to the third position upon the pressure in the housing reaching a predetermined pressure.

The opening sleeve defining a plurality of fluid openings therethrough, the fluid openings in the opening sleeve being communicated with the flow ports only in the second position of the opening sleeve.

The opening sleeve having a first outer diameter and a second outer diameter, the first outer diameter being greater than the second diameter, the cementing tool further comprising a stop piston positioned in an annulus defined between the second outer diameter and the outer housing, the stop piston being detachably connected to the outer housing and located to hold the opening sleeve in the second position.

A stop piston configured to detach and permit the opening sleeve to move from the second to the third position upon the application of a predetermined pressure applied in the housing above the closing plug.

A snap ring disposed about the opening sleeve on the second diameter thereof, the snap ring configured to radially expand in the second position of the opening sleeve.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A cementing tool comprising:

an outer housing defining a central flow passage and a plurality of housing flow ports through a wall thereof;

an opening sleeve having a first opening sleeve face and a second opening sleeve face exposed to pressure in the outer housing, the first opening sleeve face having a greater surface area than the second opening sleeve face so that the pressure in the outer housing creates a pressure differential between the first opening sleeve face and the second opening sleeve face sufficient to move the opening sleeve from a first position covering the plurality of housing flow ports to a second position in which flow through the plurality of housing flow ports is permitted; and an opening seat defined on the opening sleeve configured to receive an opening plug displaced into the outer housing, the opening sleeve also being movable from the first to the second position as a result of the opening plug engaging the opening seat and an application of pressure above the opening seat in the outer housing.

2. The cementing tool of claim 1, the opening sleeve having a plurality of fluid openings therethrough communicated with the housing flow ports in the outer housing to permit flow therethrough into an annulus defined by the outer housing and a well bore wall in the second position of the opening sleeve.

3. The cementing tool of claim 1, the opening sleeve being movable from the second position to a third position in the outer housing to prevent flow through the housing flow ports in the outer housing.

4. The cementing tool of claim 3, further comprising a closing seat positioned in the opening sleeve, the closing seat configured to engage a closing plug delivered into the outer housing after the opening sleeve has moved to the second position, the opening sleeve movable to the third position upon an application of pressure in the outer housing above the closing plug.

5. The cementing tool of claim 1, further comprising a closing sleeve detachably connected in the outer housing, the closing sleeve movable from a first position in the outer housing to a second position in the outer housing after the opening sleeve has moved to its second position, the closing seat positioned in the outer housing to prevent flow through the housing flow ports in the second position of the closing sleeve.

6. The cementing tool of claim 5, the closing sleeve defining a closing seat therein configured to engage a closing plug displaced into the outer housing.

7. The cementing tool of claim 1, further comprising a protective sleeve connected to the opening sleeve and extending upwardly therefrom, the protective sleeve defining a plurality of fluid apertures therethrough, the fluid apertures being communicated with an annular fluid passageway defined between the outer housing and the protective sleeve, the first sleeve face being open to the pressure in the outer housing through the plurality of fluid apertures and the annular fluid passageway.

8. A cementing tool comprising:

an outer housing connectable in a tubing string, the outer housing defining a central flow passage and having a plurality of housing flow ports through a wall thereof;

an opening sleeve movable in the outer housing from a first position in which flow through the housing flow ports is blocked to a second position in the outer housing in which flow from the central flow passage is permitted through the housing flow ports, the opening sleeve movable as a result either of differential pressure acting on the opening sleeve or an application of pressure in the outer housing to an opening plug that engages an opening seat on the opening sleeve; and the opening sleeve being movable from the second to a third position in the outer housing in which flow through the housing flow ports from the central flow passage is prevented.

9. The cementing tool of claim 8, further comprising first and second sleeve faces defined on the opening sleeve and open to tubular pressure, the first sleeve face having a greater surface area than the second sleeve face so that the differential-pressure sufficient to move the opening sleeve from the first position to the second position is created.

10. The cementing tool of claim 9, further comprising a closing seat configured to engage a closing plug, the opening sleeve movable from the second to the third position upon the pressure in the outer housing reaching a predetermined pressure.

11. The cementing tool of claim 8, the opening sleeve defining a plurality of fluid openings therethrough, the fluid openings in the opening sleeve being communicated with the housing flow ports only in the second position of the opening sleeve.

12. The cementing tool of claim 8, the opening sleeve having a first outer diameter and a second outer diameter, the first outer diameter being greater than the second outer diameter, the cementing tool further comprising a stop piston positioned in an annulus defined between the second outer diameter and the outer housing, the stop piston being detachably connected to the outer housing and located to hold the opening sleeve in the second position.

13. The cementing tool of claim 12, further comprising a closing seat in the opening sleeve configured to engage a closing plug, the stop piston configured to detach and permit the opening sleeve to move from the second to the third position upon an application of a predetermined pressure applied in the outer housing above the closing plug.

14. The cementing tool of claim 13, further comprising a snap ring disposed about the opening sleeve on the second diameter thereof, the snap ring configured to radially expand in the second position of the opening sleeve.

15. A cementing tool comprising:

an outer housing defining a central flow passage therethrough and a plurality of housing flow ports in a wall thereof;

an opening sleeve detachably connected in the outer housing, the opening sleeve having first and second sleeve faces defined thereon open to tubular pressure and movable from a first position in which flow from the central flow passage through the housing flow ports is prevented to a second position in which flow from the central flow passage through the housing flow ports is permitted, the first sleeve face having a greater surface area than the second sleeve face such that the tubular pressure creates a differential pressure acting on the opening sleeve; and an opening seat defined in the opening sleeve configured to receive an opening plug such that tubular pressure applied above the opening plug will move the opening sleeve from the first to the second position in the event that the differential pressure fails to move the opening sleeve from the first to the second position.

16. The cementing tool of claim 15, the opening sleeve being movable from the second to a third position in which no flow is permitted from the central flow passage through the housing flow ports.

17. The cementing tool of claim 15, further comprising a closing sleeve detachably connected in the outer housing above the opening sleeve, the closing sleeve movable from a first position to a second position in the outer housing to prevent flow through the housing flow ports after cement has been flowed through the housing flow ports in the outer housing.

18. The cementing tool of claim 17, a lower end of the closing sleeve and the first opening sleeve face defining a space therebetween, the tubular pressure communicated to the opening sleeve face through the space.

19. The cementing tool of claim 15 further comprising a protective sleeve connected to the opening sleeve, the first sleeve face being open to tubular pressure through flow apertures defined in the protective sleeve.

20. The cementing tool of claim 15 further comprising a closing seat defined in the opening sleeve configured to receive a closing plug.

* * * * *